United States Patent [19]

Laidlaw

[11] 4,405,240

[45] Sep. 20, 1983

[54] AEROSLIDE CONSTRUCTION

[75] Inventor: Walter Laidlaw, Dallas, Tex.

[73] Assignee: Claudius Peters, Inc., Dallas, Tex.

[21] Appl. No.: 249,716

[22] Filed: Mar. 31, 1981

[51] Int. Cl.[3] ..... B01F 13/02; B65G 53/20

[52] U.S. Cl. ..... 366/101; 222/195; 222/630; 406/138

[58] Field of Search ..... 366/101, 106, 107; 222/195, 630; 406/138, 38, 137; 220/73, 74

[56] References Cited

U.S. PATENT DOCUMENTS

| | | | |
|---|---|---|---|
| 2,609,125 | 9/1952 | Schemm . | |
| 3,236,422 | 2/1966 | Bailey et al. . | |
| 3,438,682 | 4/1969 | Mohrhusen | 406/138 X |
| 3,862,505 | 1/1975 | Jeroma | 220/74 X |

FOREIGN PATENT DOCUMENTS

| | | | |
|---|---|---|---|
| 1139794 | 11/1962 | Fed. Rep. of Germany . | |
| 2009417 | 9/1970 | Fed. Rep. of Germany | 222/195 |
| 96078 | 7/1973 | Fed. Rep. of Germany . | |
| 2847004 | 3/1981 | Fed. Rep. of Germany . | |

*Primary Examiner*—Philip R. Coe
*Assistant Examiner*—Joseph M. Pitko
*Attorney, Agent, or Firm*—Michael A. O'Neil; Harold E. Meier

[57] ABSTRACT

An aeroslide (50) includes a molded plastic base (52) comprising a bottom wall (54), side walls (56) extending upwardly from the bottom wall and end walls (58) extending upwardly from the bottom wall and joining the side walls to enclose the interior of the base. Indentations (66) are formed in the upper portions of the side walls, and reinforcing members (68) are adhesively secured in the indentations at spaced points along the length of the base. Flanges (60) extend outwardly from the upper ends of the side walls and the end walls, and a porous fabric layer (70) is secured in place over the open top of the base by an adhesive layer extending between the upper surface of the flanges and the adjacent undersurface of the fabric layer.

9 Claims, 4 Drawing Figures

AEROSLIDE CONSTRUCTION

TECHNICAL FIELD

This invention relates to an aeroslide construction which is particularly adapted for use in mixing chamber silos.

BACKGROUND AND SUMMARY OF THE INVENTION

It is known that various types of materials can advantageously be mixed together by means of a mixing chamber silo. For example, the assignee of the present invention provides a mixing chamber silo including a housing comprising a right circular cylinder having a vertically extending axis. Materials to be mixed together enter the cylinder at the top, and flow downwardly through the cylinder under the action of gravity.

A plurality of aeroslides are mounted in the bottom of the cylinder. The function of the aeroslides is to form the material into a fluidized bed and thereby facilitate the mixing process. The aeroslides may be mounted angularly so that the fluidized material flows in a predetermined direction under the action of gravity.

Although the aeroslides heretofore used in the construction of mixing chamber silos have performed adequately, certain disadvantages have been noted. First, prior art aeroslides have utilized a base formed from heavy gauge steel. As a result, the aeroslides have been expensive to manufacture and have been unnecessarily cumbersome to tranport and install. Second, prior art aeroslides have utilized a fabric layer which is secured in place by means of bolts passing through aligned holes in opposed flanges. This manufacturing technique also adds unnecessarily to the cost of aeroslides.

The present invention comprises an aeroslide construction which overcomes the foregoing and other difficulties long since noted with the prior art. In accordance with the broader aspects of the invention, an aeroslide incorporates a base which is formed from molded plastic. In order to provide the necessary strength, reinforcing members are mounted at spaced points along the length of the base and are adhesively secured in place. The fabric layer is secured to the base by means of adhesives. Thus, aeroslides manufactured in accordance with the present invention are both more economical and lighter in weight when compared with aeroslides manufactured in accordance with prior art techniques.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
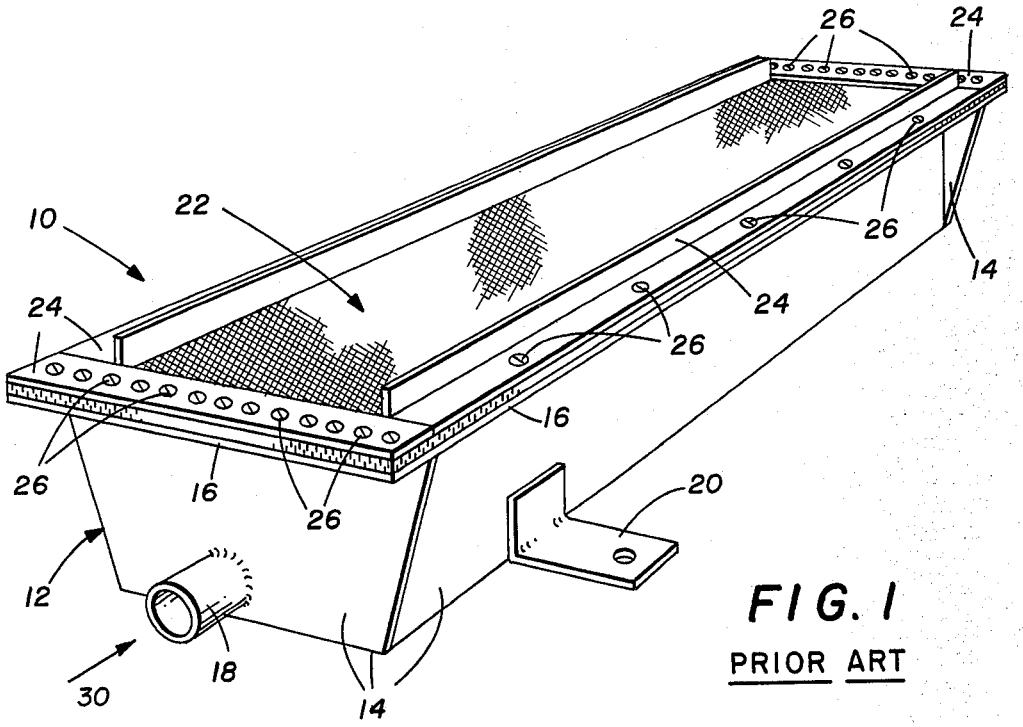
FIG. 1 PRIOR ART
FIG. 1 is a perspective view illustrating a prior art aeroslide construction.

Referring now to the Drawings, and particularly to FIG. 1 thereof, there is shown an aeroslide 10 constructed in accordance with prior art techniques. The aeroslide 10 includes a base 12 formed from a plurality of heavy gauge steel panels 14 which are secured together by welding. A flange 16 extends outwardly from the upper end of each panel 14. An inlet aperture is formed in the base 12 at a convenient point in one of the panels 14, and an inlet sleeve 18 is secured to the panel 14 in alignment with the inlet aperture. One or more attachment brackets 20 may be utilized to secure the aeroslide 10 in place. The inlet sleeve 18 and the attachment bracket 20 are formed from steel and are secured to the base 13 by welding.

The base 12 of the aeroslide 10 is generally U-shaped in cross section and has closed ends and open top. The aeroslide 10 further includes a fabric layer 22 which is secured across the open top of the base 12. A plurality of flanges 24 extend around the entire periphery of the fabric layer 22, and a plurality of bolts 26 extend through aligned holes formed in the flanges 24 and the underlying flanges 16. A nut (not shown) is threadedly engaged with each bolt 26 and engages the underside of the flange 16, whereby the bolts and nuts function through the flanges 24 and 16 to secure the fabric layer 22 across the open top of the base 12.

In the use of the aeroslide 10, the base 12 functions as a plenum. Compressed air enters the base 12 through the sleeve 18 in the direction indicated by the arrow 30. The compressed air in turn flows outwardly from the base 12 through the fabric layer 22. Outward flow of air through the fabric layer 22 functions to fluidize materials situated over the aeroslide 10, that is, above the fabric layer 22.

Figure 2:
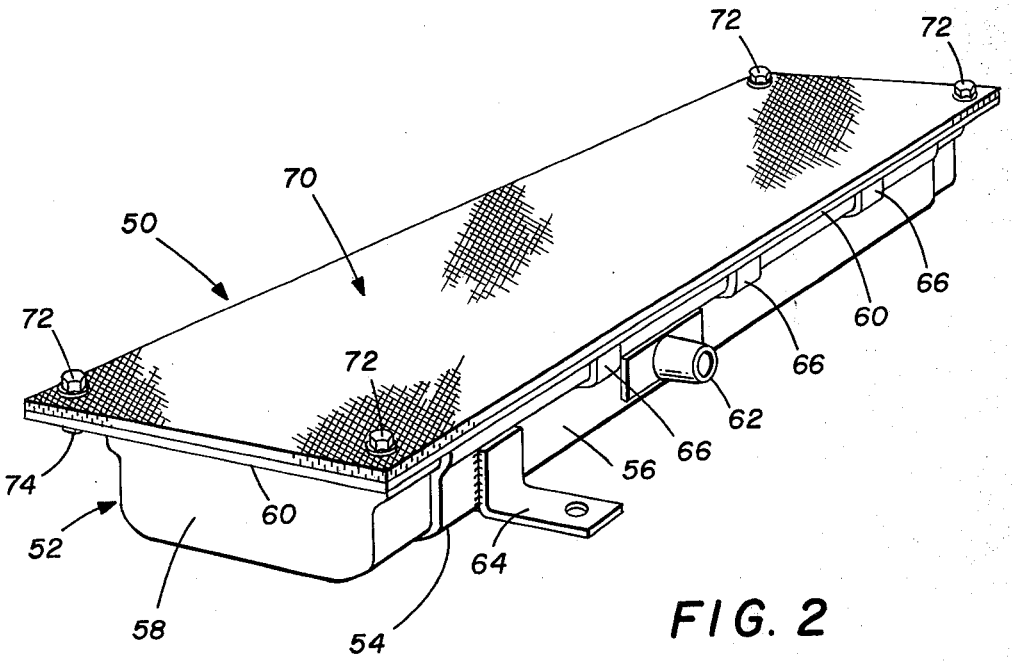
FIG. 2 is a view similar to FIG. 1 illustrating an aeroslide construction incorporating the present invention.

Referring now to FIG. 2, there is shown an aeroslide 50 incorporating the present invention. The aeroslide 50 includes a base 52 comprising a unitary structure formed from molded plastic material. The base 52 may advantageously be formed from ABS plastic material, however, other types of plastic material may also be used in the practice of the invention, if desired.

The base 52 includes a bottom wall 54. Side walls 56 extend upwardly from the bottom wall 54. End walls 58 also extend upwardly from the bottom wall 54 and join the side walls 56 to enclose the interior of the base 52. Flanges 60 extend outwardly from the upper ends of the walls 56 and 58 around the entire periphery of the base 52. The base 52 is provided with an inlet aperture formed at a convenient point in one of the walls 56 or 58 and an inlet sleeve 62 secured to the base 52 in alignment with the inlet aperture. One or more brackets 64 may be utilized to secure the aeroslide 50 in place. The inlet sleeve 62 and the bracket 64 are formed from plastic material by means of conventional techniques and are secured to the base 52 by means of adhesive.

Figure 3:
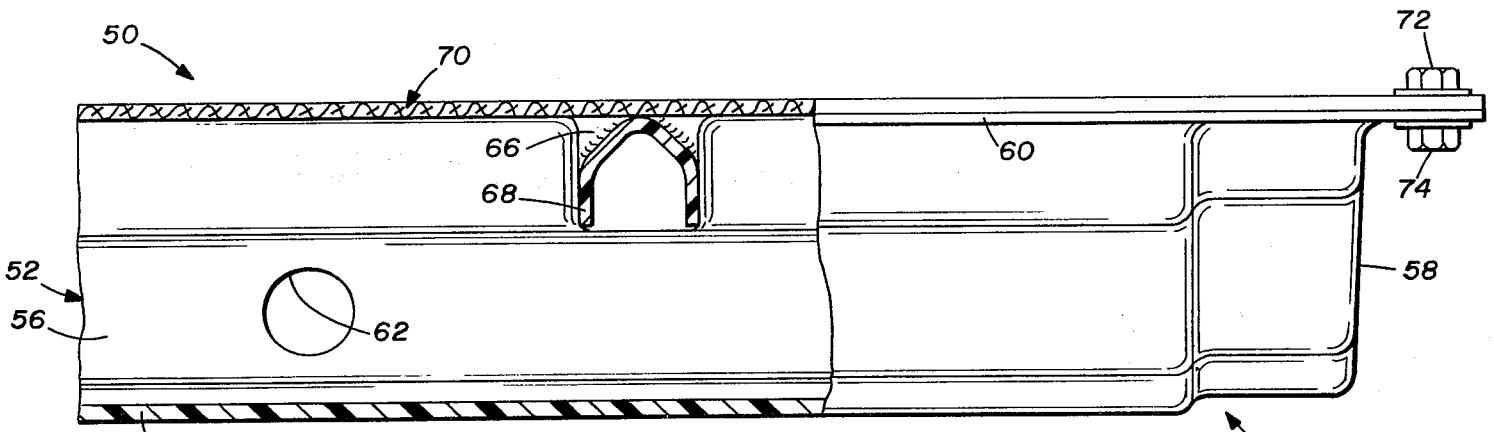
FIG. 3 is a partial side view of the aeroslide of FIG. 2 in which certain parts have been broken away to more clearly illustrate certain features of the invention.

A plurality of sets of opposed recesses 66 are formed in the side walls 56 at spaced points along the length of the base 52. As is best shown in FIG. 3, the base 52 is reinforced by brace members 68 which are received in the opposed recesses 66. The brace members 68 have an inverted U-shaped cross sectional configuration, and are secured in place in the recesses 66 by means of adhesive.

The aeroslide 50 further includes a fabric layer 70. The fabric layer 70 is formed from a porous plastic material and may advantageously comprise woven acrylic plastic belting material. In accordance with the preferred embodiment of the invention the fabric layer 70 comprises five-ply woven acrylic plastic belting material, however, four-ply woven acrylic plastic belting material has also been successfully employed in the practice of the invention. Other types of porous plastic material may also be utilized as the fabric layer 70, in accordance with particular requirements.

The fabric layer 70 has a rectangular periphery which is coincident with the periphery of the flanges 60 extending outwardly from the upper ends of the side walls 56 and the end walls 58. The fabric layer 70 is secured in place over the open top of the base 52 by means of an adhesive layer extending between the upper surfaces of the flanges 60 and the adjacent regions of the lower surface of the fabric layer 70. The adhesive layer preferably comprises type 1942 adhesive manufactured by the Andolin Corporation, however, other types of adhesives may be used in the practice of the invention, if desired.

The fabric layer 70 is further secured to the base 52 by means of four stainless steel bolts 72 which extend through the fabric layer 70 at the four corners thereof and through the adjacent corners of the flanges 60. The bolts 72 are threadedly engaged by nuts 74 and therefore function in cooperation with the adhesive layer to fully secure the fabric layer in engagement with the base.

Figure 4:
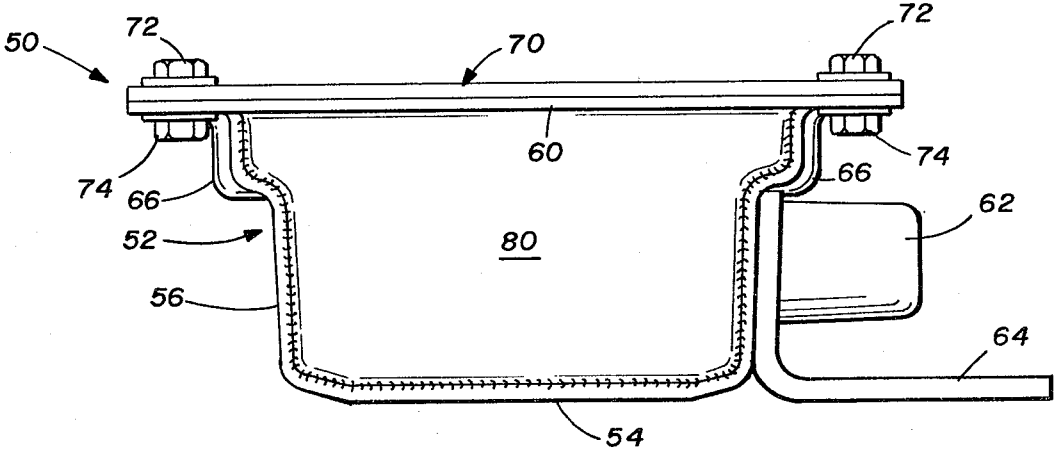
FIG. 4 is an end view illustrating a modification of the aeroslide of FIG. 2.

FIGS. 3 and 4 illustrate additional features of the invention. The opposite ends of the bottom wall 54 and the side walls 56 of the base 52 may be indented as illustrated at 78. The amount of the indentation 78 is preferably substantially equal to the thickness of the molded plastic material comprising the base 52. This permits an aeroslide of extended length to be formed by removing one end of a first aeroslide at a point beyond the indentation 78 and removing the opposite end wall 58 of another aeroslide.

The aeroslide having the indented portion removed is then positioned in an overlapping relationship to the indented portion of the aeroslide wherein the end wall 58 was removed, and the two aeroslides are secured together by means of adhesive. The abutting portions of the flanges 60 of the two aeroslides are likewise joined by means of adhesives. A continuous piece of fabric is then stretched and attached to the unit or multiple unit aeroslide. In this manner an aeroslide of substantially double length can be prepared, and the process can be continued until the desired aeroslide length is achieved.

It will also be understood that in some instances it will be found advantageous to provide an aeroslide which is shorter than the standard length. In such cases the standard length aeroslide is cut to provide an aeroslide having the desired length, and an end plate 80 is positioned in the resulting open end of the cut aeroslide. The end plate 80 is secured around its periphery to the bottom wall 54 and the side walls 56 of the aeroslide by means of adhesive, and is also adhesively secured to the fabric layer 68 of the aeroslide.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. An aeroslide comprising:

a molded plastic base comprising a unitary structure including a bottom wall, side walls extending upwardly from the bottom wall, end walls extending upwardly from the bottom wall and connected to the side walls to enclose the interior of the base, and flanges extending outwardly from the upper ends of the side walls and the end walls to define the upper periphery of the base;

each of the side walls of the base having a plurality of indentations formed in the top thereof, the indentations being positioned at spaced points along the lengths of the side walls, each of the indentations in one of the side walls being aligned with a corresponding indentation in the other side wall, each of the indentations being closed outwardly, laterally and downwardly and being open inwardly and upwardly;

a plurality of plastic reinforcing members each having opposite ends received and adhesively secured in aligned indentations of the side walls so that the reinforcing members are located at spaced apart points along the length of the base;

a porous fabric layer overlying and extending substantially parallel to the bottom wall of the base and having a periphery coincident with the upper periphery of the base as defined by the flanges;

an adhesive layer positioned between the upper surfaces of the flanges and the adjacent undersurface of the fabric layer for adhesively securing the fabric layer to the base; and means for admitting a pressurized fluid into the base so that the fluid flows outwardly through the porous fabric layer to fluidize materials positioned over the aeroslide.

2. The aeroslide according to claim 1 wherein the reinforcing members have an inverted U-shaped cross section.

3. The aeroslide according to claim 1 wherein the upper periphery of the base and the periphery of the fabric layer define a rectangular configuration including four corners, and further including at least four bolts each positioned at one of the four corners of the upper periphery of the base and the fabric layer and extending through the fabric layer and the flanges for further securing the fabric layer to the base.

4. The aeroslide according to claim 1 wherein the bottom wall and the side walls of the base are indented at at least one end thereof by an amount substantially equal to the thickness of the plastic material comprising the base to facilitate mating engagement between adjacent aeroslides.

5. The aeroslide according to claim 1 wherein the fabric layer comprises porous multiply acrylic belting material.

6. The aeroslide according to claim 1 wherein the base comprises ABS plastic material.

7. An aeroslide comprising a molded plastic base comprising a unitary structure including a bottom wall, side walls extending upwardly from the bottom wall, end walls extending upwardly from the bottom wall and connected to the side walls to enclose the interior of the base, and flanges extending outwardly from the upper ends of the side walls and the end walls to define the upper periphery of the base;

a plurality of indentations formed in the upward portion of each of the side walls at spaced points along the length of the base, each of the indentations formed in one of the side walls being aligned with a corresponding indentation formed in the other side wall;

a plurality of plastic reinforcing members each received and adhesively secured in indentations of the side walls for reinforcing the base;

a layer of porous multiply acrylic belting material extending over and substantially parallel to the bottom of the base and having a periphery coincident with the upper periphery of the base as defined by the flanges;

an adhesive layer positioned between the upper surfaces of the flanges and the adjacent undersurface of the layer of porous multiply acrylic belting material for adhesively securing the belting material to the base; and means for admitting a pressurized fluid into the base so that the fluid flows outwardly through the porous fabric layer.

8. The aeroslide according to claim 7 wherein the bottom wall and the side walls of the base are indented at at least one end thereof by an amount substantially equal to the thickness of the plastic material comprising the base to facilitate mating engagement between adjacent aeroslides.

9. The aeroslide according to claim 8 wherein the upper periphery of the base and the periphery of the fabric layer define a rectangular configuration including four corners, and further including at least four bolts each positioned at one of the four corners of the upper periphery of the base and the fabric layer and extending through the fabric layer and the flanges for further securing the fabric layer to the base.

* * * * *